United States Patent [19]

Inoue

[11] 4,371,230

[45] Feb. 1, 1983

[54] ELECTRIC CONNECTOR

[75] Inventor: Nori Inoue, Yokkaichi, Japan

[73] Assignee: Tokai Electric Wire Company Limited, Yokkaichi, Japan

[21] Appl. No.: 230,793

[22] Filed: Feb. 2, 1981

[30] Foreign Application Priority Data

Feb. 2, 1980 [JP] Japan ..... 55-11668

[51] Int. Cl.[3] ..... H01R 11/12; H01R 11/32

[52] U.S. Cl. ..... 339/242; 339/258 S; 339/277 R

[58] Field of Search ..... 339/32 R, 32 M, 47 R, 339/47 C, 49 R, 242, 257, 277 R, 277 C, 33, 258 S

[56] References Cited

U.S. PATENT DOCUMENTS 3,316,522 4/1967 Demler, Sr. ..... 339/47 C

FOREIGN PATENT DOCUMENTS 597282 8/1925 France ..... 339/47 R 229811 3/1925 United Kingdom ..... 339/277 R

*Primary Examiner*—Neil Abrams

*Attorney, Agent, or Firm*—Cushman, Darby & Cushman

[57] ABSTRACT

An electric terminal for facilitating the formation of a wire harness and attaching of the wire harness to an electric equipment in the production of the latter. The connector includes a flat terminal which comprises a ring-shaped flat terminal portion having a bolt hole formed therein, a tab projected radially outwardly from the periphery of the terminal portion, and a wire crimping portion projected also radially outwardly from the terminal portion. The base portion of the wire crimping portion constitutes a tab insertion opening for receiving the tab of another terminal, so that a plurality of connectors can be assembled together in such a state that the tab of one connector fits in the tab insertion opening of another connector. It is therefore possible to assemble a plurality of wire harness elements together before attaching them to a common electric connector bolt.

4 Claims, 19 Drawing Figures

ELECTRIC CONNECTOR

BACKGROUND OF THE INVENTION

1. Field of the Invention

The present invention relates to an improvement in flat electric connector for facilitating the assembling of wire harnesses for internal wiring of electric equipments, as well as the attaching of the wire harness to the electric equipment.

2. Description of the Prior Art

In general, in order to interconnect the components in an electric equipment, a wire harness is assembled by connecting electric connectors to a network of wires laid in accordance with the layout of the components and then winding with tapes so as to bind the connectors and wires together.

Thus assembled wire harnesses are installed in the electric equipments while the latter are moving on an assembling conveyor. It follows therefore that the step of attaching the connectors such as flat connectors over the terminal bolts of the electric components and tightening the nuts must be accomplished quickly and without fail.

When two prior art crimp type ring terminals shown in FIG. 1 are mounted on a single bolt and are tightened by means of a nut to clamp them securely, it occurs very often that, because the crimping portion is thicker than the ring portion, the upper terminal rides over the crimping portion of the lower terminal so that the two terminals do not contact each other sufficiently closely, resulting in an inferior assembling. To avoid this, the worker has to tighten the nut while correctly positioning the two terminals in relation to each other, in such a manner as to avoid the overlapping of crimping portions of these two terminals.

FIGS. 2 and 3 show other types of prior art terminal in which two wires are beforehand crimped on the terminal before the latter is secured to the bolt to overcome the above-described drawback.

These known terminals, however, requires an assembling process as illustrated in FIGS. 4*a* to 4*d*, resulting in a lowered efficiency of assembling of the wire harness.

Namely, in the assembling process for assembling the wire harness as shown in FIGS. 4*a* to 4*d* employs the steps of preparing two wire elements A, B as shown in FIG. 4*a*, connecting branching lines A', B' to these wire elements A, B in a manner shown in FIG. 4*b*, crimping the branching lines A', B' to the common terminal C in a manner shown in FIG. 4*c* and binding the wire elements A, B with a tape D wound therearound in a manner illustrated in FIG. 4*d*. The difficulty rises particularly in the step of crimping the branching wires A', B' to the common terminal C shown in FIG. 4*c*, because it is necessary to bring the wire elements of considerable length to the position of the crimping machine and to stack the same at the position near the crimping machine, to deteriorate the condition of the work resulting in a lowered efficiency of the work.

SUMMARY OF THE INVENTION

Under this circumstance, the present invention aims at providing a novel electric connector which permit two or more wires having crimp type ring terminals to be secured to the bolt while restricting the positions of these terminals in relation to each other in such a manner as to avoid the undesirable overlapping of the wire crimping portions of these terminals, thereby to overcome the above-described problems of the prior art.

To this end, according to the invention, there is provided an electric connector which comprises a flat terminal including a flat ring-shaped terminal portion having a bolt hole formed therein, a tab extending radially outwardly from the ring-shaped terminal portion and a wire crimping portion projecting also radially outwardly from the ring-shaped terminal portion, the wire crimping portion being provided at its base portion with a tab insertion opening for receiving the tab of another flat terminal, whereby two or more flat terminals are assembled together in such a manner that the tab of one flat terminal fits in the tab insertion opening of another flat terminal.

The above and other objects, novel features as well as advantages of the invention will become more apparent from the description of the preferred embodiment taken in connection with the accompanying drawings.

DESCRIPTION OF THE PREFERRED EMBODIMENT

A preferred embodiment of the invention will be described hereinunder with specific reference to FIGS. 5 to 14.

Figure 6:
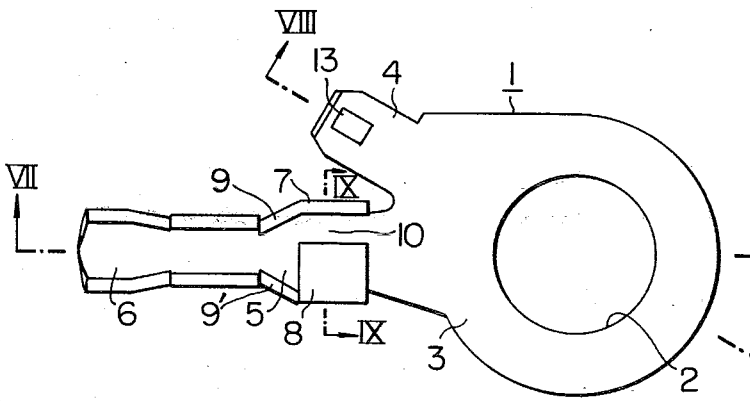
FIG. 6 is a plan view of a flat electric terminal embodying the present invention.

Referring to these Figures, particularly to FIG. 6, a flat electric terminal of the invention generally designated at a reference numeral 1 includes a flat ring-shaped termimnal portion 3 having a bolt hole 2 formed at the center thereof, a tab 4 extending radially outwardly from the periphery of the terminal portion 3, a base portion 5 extending also radially outwardly from the periphery of the terminal portion 3, and a wire crimping portion 6 continuing from the base portion 5 thereof.

More specifically, the base portion 5 has a vertical wall 7 standing upright from one lateral side thereof, a resilient arm 8 standing up from the other lateral side and bent in a cantilevered manner to make the free end oppose to the major surface of the base portion 5 and a pair of holder walls 9, 9' which protrude upward from the major surface of the base portion 5 so as to oppose to each other, the distance between the two holder walls 9, 9' being gradually reduced toward the outer end of the base portion 5, so that the outer end part of the base portion 5 where the holder walls 9, 9' are formed linearly interconnect the major part of the base portion 5 to the wire crimping portion 6 having a width smaller than that of the base portion 5.

The major surface of the base portion 5, vertical wall 7, resilient arm 8 and the holder arms 9, 9' in combination constitute a tab insertion opening 10 for receiving, as will be explained latter, the tab of another similar terminal.

Figure 10:
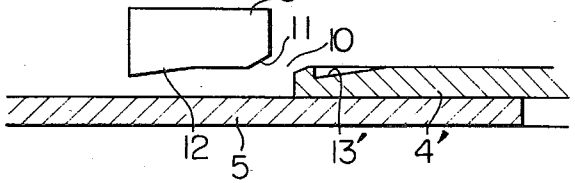
FIG. 10 is an illustration of the manner in which a tab of a first connector is inserted into a tab insertion opening of another connector.

As will be most clearly seen from FIG. 10, the lower edge of the free end of the resilient arm 8 is cut at its end closer to the terminal portion 3 to form a tab guide portion 11. Also, the lower edge of the free end is tapered gradually downwardly toward the wire crimping portion 6 to constitute a downward projection 12.

The tab 4 has a planar shape substantially conforming the shape of the major part of the base portion 5 defined by the vertical wall 7, resilient arm 8 and holder walls 9, 9', and is gradually narrowed toward its end in conformity with the distance between opposing holder walls 9, 9' which decreases gradually toward the outer end of the base portion 5 as stated before. The tab 4 is provided also with a groove 13 formed in the upper face thereof, the depth of the groove 13 being gradually increased toward the outer end of the tab 4 so as to correspond to the increase of the projection amount of the projection 12 formed at the extremity of the free end of resilient arm 8. Of course it is possible to replace the groove 13 by a slot adapted to be engaged by the free end of the arm 8. As will be seen from FIG. 11, the outer end of the tab 4 is tapered or rounded at the upper end thereof.

Figure 13:
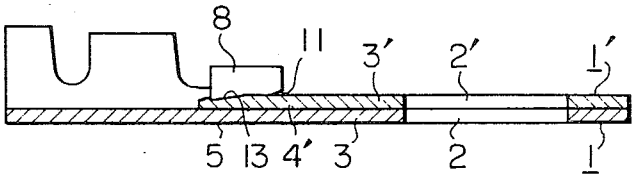
FIG. 13 is a sectional view taken along the line XIII—XIII of FIG. 12.
Figure 14:
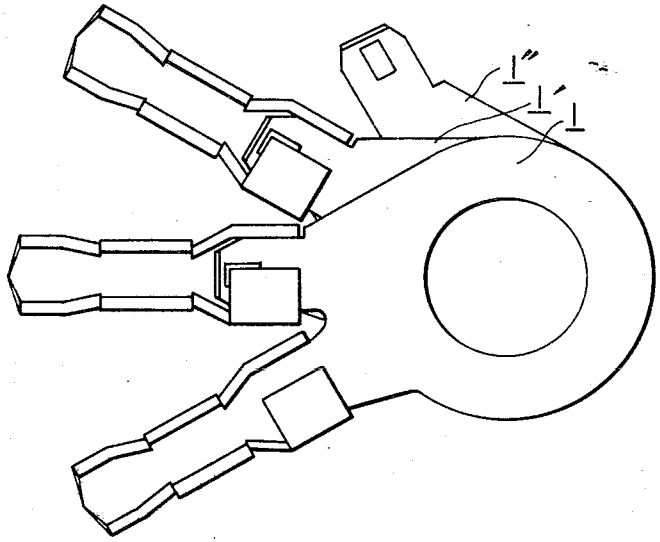
FIG. 14 is an illustration of three electric terminals of the invention assembled together.

The tab 4 and the tab insertion opening 10 are so located in relation to each other that, when the tab insertion opening 10 of a first connector 1 receives the tab 4' of a second connector 1' in a manner illustrated in FIG. 13, the ring-shaped terminal portions 3, 3' of two terminals correctly lap in vertical alignment with each other.

Figure 11:
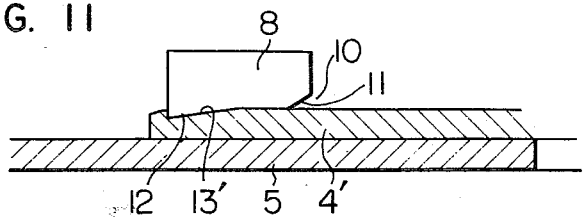
FIG. 11 is an illustration of the tab received by the tab insertion opening.
Figure 12:
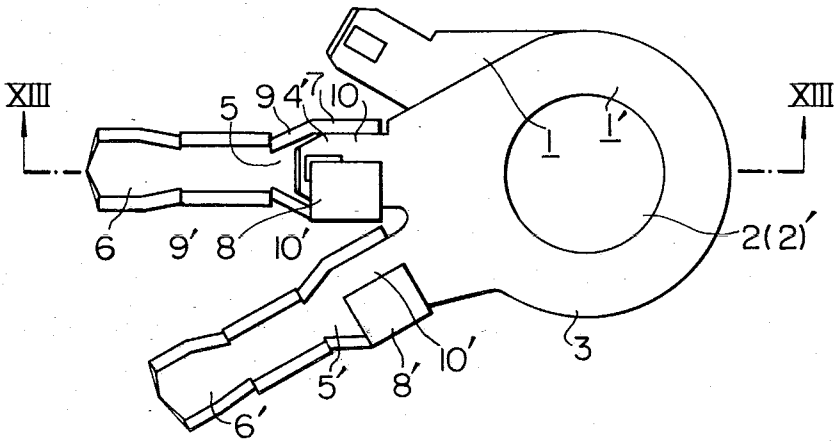
FIG. 12 is an illustration of a pair of assembled electric connectors in accordance with the invention.

For assembling two connectors 1, 1' together, the tab 4' of the second connector 1' is simply slided on the upper surface of the ring-shaped terminal portion 3 of the first connector 1, into the tab insertion opening 10 of the latter, as will be understood from FIGS. 11 and 12. Partly because the tab 4' is tapered or rounded at its upper edge of outer end thereof, and partly because the guide portion 11 formed at the end of the resilient arm adjacent to the terminal portion 3 effectively guides the tab 4, the tab 4 is inserted smoothly into the gap between the lower edge of the free end of resilient arm 8 and the major surface of the base portion 5, overcoming the frictional resistance generated by the resilient pressing force exerted by the resilient arm 8. The sliding of the tab 4' into the tab insertion opening is stopped when the end of the tab 4' abuts the holder walls 9, 9'. In this state, the downward projection 12 of the resilient arm 8 snaps into the groove 13'.

Once this state is achieved, the tab 4' is prevented from being moved in the axial direction because its end abuts the holder walls 9, 9' and because the downward projection 12 fits in the groove 13'. Also, the movement of the tab 4' in the direction perpendicular to the axis is prevented by the vertical wall 7 and the rising portion of the resilient arm 8. Furthermore, the vertical movement, i.e. the movement away from the plane of the major surface of the base portion 5, of the tab 4' is prevented by the pressing force exerted by the resilient arm 8.

Figure 4B:
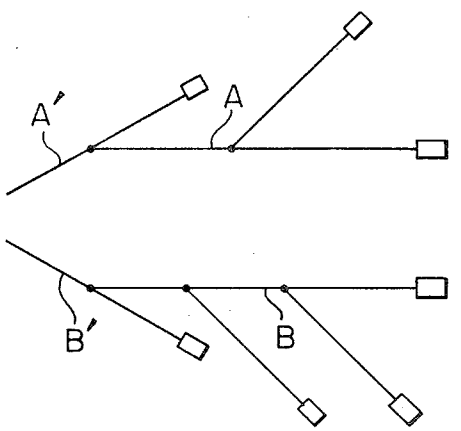
FIG.4b PRIOR ART
FIGS. 4*a* to 4*d* illustrate steps of assembling of a wire harness with conventional flat electric terminals shown in FIGS. 1 to 3.
Figure 4A:
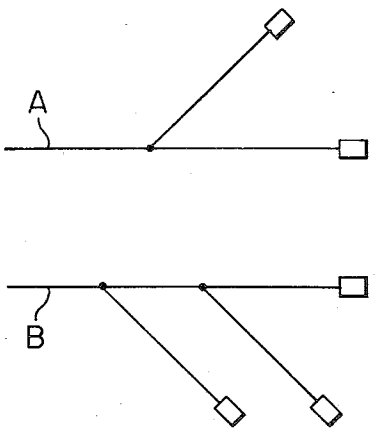
FIG.4a PRIOR ART
Figure 4D:
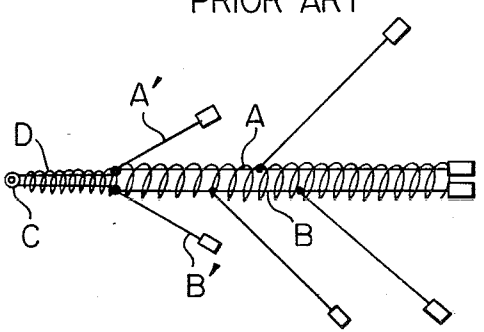
FIG.4d PRIOR ART
Figure 4C:
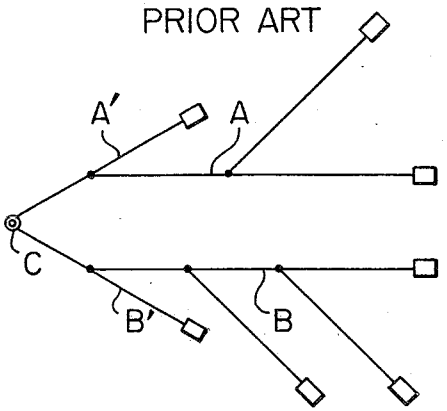
FIG.4c PRIOR ART
Figure 1:
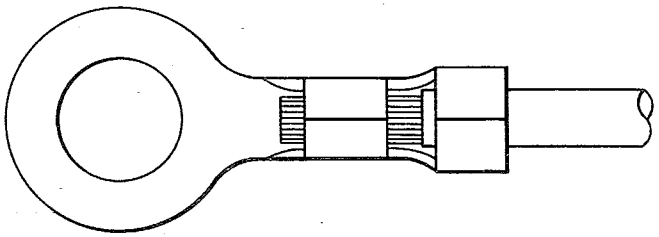
FIG. 1 PRIOR ART
FIGS. 1 to 3 are plan views of conventional flat electric connectors.
Figure 2:
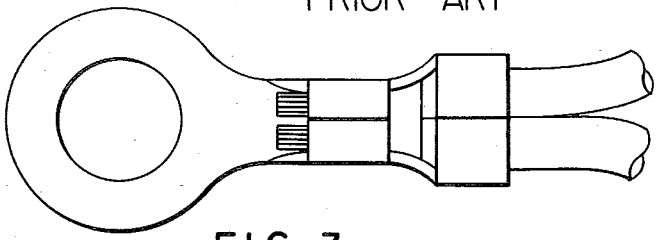
FIG. 2 PRIOR ART
Figure 3:
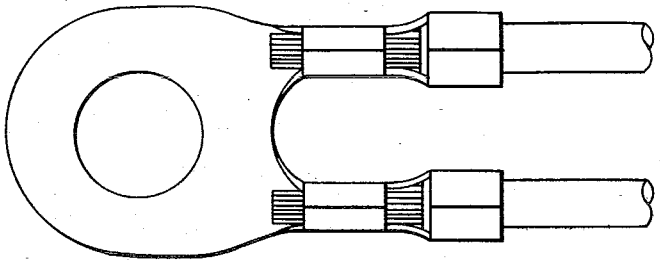
FIG. 3 PRIOR ART
Figure 5C:
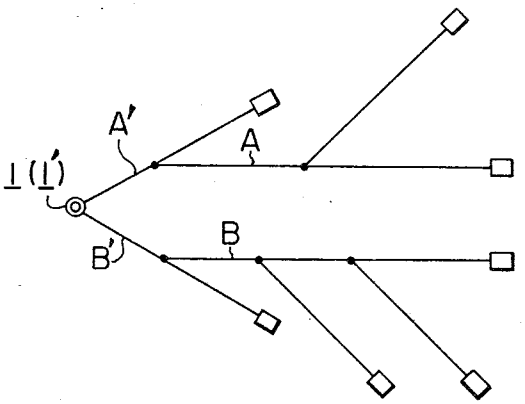
FIGS. 5*a* to 5*c* illustrate the steps of assembling of a wire harness with the flat electric connector in accordance with the invention.
Figure 5B:
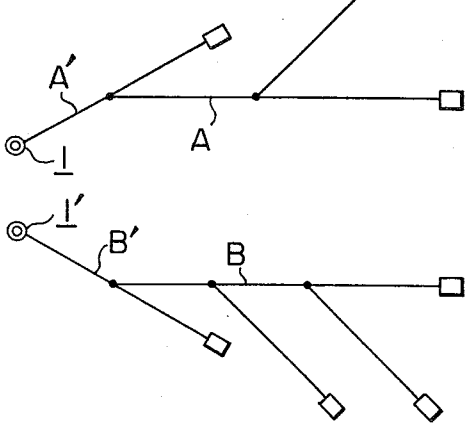
Figure 5A:
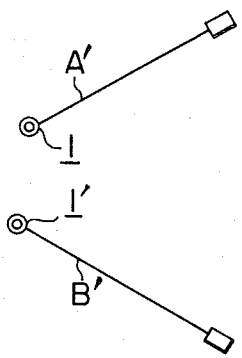
Figure 7:
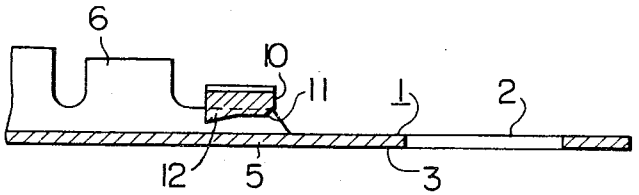
FIG. 7 is a sectional view taken along the line VII—VII of FIG. 6.
Figure 8:
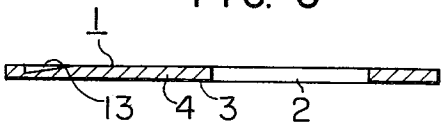
FIG. 8 is a sectional view taken along the line VIII—VIII of FIG. 6.
Figure 9:
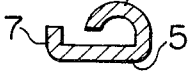
FIG. 9 is a sectional view taken along the line IX—IX of FIG. 6.

A plurality of electric terminals of the invention, each having the above-described construction, can be assembled to form a wire harness by a process illustrated in FIGS. 5*a* to 5*c*.

Namely, branch lines A', B' are beforehand connected to the wire crimping portions 6, 6' by means of a crimping machine as shown in FIG. 5*a* and lines are added as desired to form wire harness elements A, B as shown in FIG. 5*b*. Then, as shown in FIG. 5*c*, two connectors 1, 1' are assembled together in the manner explained before to complete a wire harness as shown in FIG. 5*c*.

It will be seen that the present invention eliminates the necessity for works such as bringing the long wire harness elements A, B to the position near the crimping machine and stacking the same at that position for crimping these elements to a common terminal, so that the working condition is much improved to ensure a higher efficiency of the work.

Furthermore, in the mass production of the electric equipments using an assembling conveyor, the efficiency of the work is very much increased because the connectors 1, 1' are beforehand superposed in such a manner as to avoid the lapping of the crimping portions 6, 6' to eliminte the troublesome work of rigidly holding the two wire harness elements to avoid the lapping of the crimping portions during tightening of the nut on the bolt.

Although the description has been made with specific reference to the case where two terminals are assembled together, the number of terminals assembled together can be increased as desired. Namely, when the circuit demands the connection of three or more wire harness elements on a single bolt, the terminals of these wire harness elements can be assembled in the same manner as the assembling of two terminals, to easily comply with the circuit demand.

As will be understood from the foregoing description, the present invention offers a great advantage of increased efficiency of the work, not only in the assembling of the terminals 1 for forming a wire harness but also in the attaching of the wire harness to electric equipments.

What is claimed is:

1. An electric connector comprising:

a flat ring-shaped terminal portion having a bolt hole formed therein;

a tab extending radially outwardly from said ring-shaped terminal portion;

a portion for receiving a tab of another like connector and having a tab insertion opening, said tab receiving portion extending radially outward from said terminal portion at an angle with respect to said tab;

a wire crimping portion extending from the outer end of said tab receiving portion in substantially the same radial direction as said tab receiving portion;

said tab and said tab receiving portion being arranged such that the tab of one electric connector may be inserted into and securely held in the tab insertion opening of another electric connector with the ring-shaped terminal portion of the one connector superposed on the ring-shaped terminal portion of the another connector.

2. The electric connector of claim 1 wherein the angle between the tab receiving portion and the tab is acute.

3. The electric connector of claim 1 wherein:

the tab insertion opening is defined by a vertical wall extending upward from one lateral side of the base portion of the tab receiving portion, a resilient arm extending upward from the other side of said base portion and having a free end bent over to oppose the base portion and opposing outward-converging walls extending upward from said sides of said base portion outward of said arm.

4. The electric connector of claim 3 wherein the resilient arm is provided at its free end with a downward projection having an inclined undersurface adapted to fit in a complementary groove formed in the opposing surface of a tab on another connector inserted in the tab receiving opening to lock the tab on the another connector in said opening.

* * * * *